US005801674A

United States Patent [19]

Shimizu

[11] Patent Number: 5,801,674

[45] Date of Patent: Sep. 1, 1998

[54] DISPLAY DEVICE AND DRIVING DEVICE THEREFOR

[75] Inventor: Kan Shimizu, Urawa, Japan

[73] Assignee: Kabushiki Kaisha Toshiba, Kawasaki, Japan

[21] Appl. No.: 534,590

[22] Filed: Sep. 27, 1995

[30] Foreign Application Priority Data

Mar. 22, 1995 [JP] Japan ..... 7-062238

[51] Int. Cl.[6] ..... G09G 3/36

[52] U.S. Cl. ..... 345/103; 345/51; 345/98

[58] Field of Search ..... 345/51, 87, 98, 345/103

[56] References Cited

U.S. PATENT DOCUMENTS 5,420,600 5/1995 Strobel et al. ..... 345/51

FOREIGN PATENT DOCUMENTS 60-142398 7/1985 Japan .
3-248122 11/1991 Japan .
5-297834 11/1993 Japan .

*Primary Examiner*—Jeffery Brier
*Attorney, Agent, or Firm*—Cushman Darby & Cushman IP Group of Pillsbury Madison & Sutro LLP

[57] ABSTRACT

In a driving system of so-called enable chain system for dividing signal electrodes of a liquid crystal display device into a plurality of signal electrode groups and driving the respective signal electrode groups by drivers formed in an IC form, a data register in the driver includes a control circuit for creating an internal start signal for controlling the timing at which the display data fetching operation is started in synchronism with a clock signal.

14 Claims, 5 Drawing Sheets

DISPLAY DEVICE AND DRIVING DEVICE THEREFOR

BACKGROUND OF THE INVENTION

1. Field of the Invention

This invention relates to a driving device for driving a display device such as a liquid crystal display device to provide a visual display according to display data.

2. Description of the Related Art

In order to deal with a large amount of display data, a display device such as a liquid crystal display device is driven in some cases by a driving circuit constructed by dividing a driver IC for driving the display device into a plurality of sections and connecting the sections in a cascade configuration.

In such a liquid crystal display device, a method of operating a necessary one of the plurality of driver ICs during the operation of the device and interrupting the operations of the other ICs is used to reduce the power consumption.

For example, in Japanese Patent KOKAI Publication No. 3-248122 published in 1991, an invention relating to the above method is disclosed. In the above publication, an X driver for supplying a display signal of the horizontal direction or X direction to the liquid crystal panel is divided into a plurality of drivers in an IC (integrated circuit) form and arranged. The plurality of drivers are cascade-connected by a so-called enable chain system.

In the enable chain system, each driver latches an enable signal from a predetermined enable source or a preceding-stage driver in response to an enable clock signal supplied from the controller to create a start signal for data fetch. Further, it receives a signal of the logical AND of the start signal and the horizontal clock signal and uses the logical AND signal as an internal clock signal to fetch display data. During this time, enable signals supplied to the other drivers are set in an inhibition state and the operations of the other drivers are interrupted. When all the display data for the driver in operation is fetched by the driver, the enable signal for the driver is set into the OFF or inhibition state.

In the above conventional method, as the signals are input from the controller to each driver, various control signals, such as the enable clock signal and horizontal clock signal are used. It is difficult to precisely maintain the timings of the control signals in each driver. For example, if the waveform of the enable clock signal or horizontal clock signal input from the controller to the driver is distorted in the transmission path from the controller to the driver, the distortion is recognized substantially as the phase lead or lag between the signals on the driver side. Then, a phase of a start signal based on the above signals is shifted and the internal clock signal generated in the driver is also delayed. As a result, a flip-flop provided in the driver to receive display data is driven at a timing defined by the delayed internal clock signal so that display data cannot be correctly fetched, and therefore, a correct display cannot be made. If the frequency of the horizontal clock signal used for creating the internal clock signal is high, tolerance for the delay of the enable clock signal is reduced. Therefore, it is necessary to lower the frequency of the horizontal clock signal when taking the delay into consideration. In this case, the operation speed of the driver is lowered and cannot be adequately used to display a large amount of data.

That is, in the conventional technique, a problem occurs such that various signals used for controlling the cascade-connected drivers make the operation speed of the driver limited by the phase lead or lag caused by the distortion of the waveform.

SUMMARY OF THE INVENTION

This invention has been made by taking the above technical background into consideration, and an object of this invention is to provide a driving device which can be operated at high speed, and a display device which can display a large amount of display data at high speed.

A driving device according to a first aspect of this invention comprises an input section having latch means for receiving control signals including a start signal, enable signal and clock signal from the exterior and display data and latching the start signal and display data in synchronism with the clock signal; control means for sampling the enable signal in response to the start signal to output an internal start signal; data holding means for starting the fetching of the display data output from the input section based on the start signal and sequentially fetching and storing the display data of a preset period; and a driving section for converting the display data stored in the data holding means into a driving voltage and outputting the driving voltage.

A display device according to a second aspect of this invention comprises an input section having latch means for receiving control signals including a start signal, enable signal and clock signal from the exterior and display data and latching the start signal and display data in synchronism with the clock signal; means for sampling the enable signal in response to the switching of the start signal to output an internal start signal; data holding means for starting the fetching of the display data output from the input section based on the internal start signal and sequentially fetching and storing the display data of a preset period; a driving section for converting the display data stored in the data holding means into a driving voltage and outputting the driving voltage; and display means for converting the driving voltage output from the driving section into an optical signal.

A display device according to a third aspect of this invention comprises a liquid crystal display panel having a plurality of scanning electrodes, a plurality of signal electrodes divided into a plurality of signal electrode groups, and liquid crystal elements arranged at intersections of the scanning electrodes and the signal electrodes; a controller for outputting control signals including a start signal, enable signal and clock signal and display data; and a plurality of drivers supplied with the display data and the control signals including the start signal, enable signal and clock signal from the controller, for fetching the display data and selectively supplying the fetched display data to the plurality of signal electrode groups. Each of the drivers include an input section having latch means for latching the start signal and display data in synchronism with the clock signal; means for sampling the enable signal in response to the switching of the start signal to output an internal start signal; data holding means for starting the fetching of the display data output from the input section based on the internal start signal and sequentially fetching and storing the display data of a preset period; and a driving section for converting the display data stored in the data holding means into a driving voltage and outputting the driving voltage.

According to the driving device and display device of this invention, the timing at which the signal electrode driver starts to fetch the display data is determined by the timing at which the enable signal from the exterior is switched by the start signal synchronized with the clock signal.

Thus, the clock signal is a signal for synchronously fetching the start signal and the display data.

Therefore, the amount of phase shift between the start signal and clock signal which are the control signals for the cascade connection of the signal electrode driver in the circuit can be reduced and the frequency of the clock signal can be enhanced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

There will now be described an embodiment of this invention with reference to the accompanying drawings.

Figure 1:
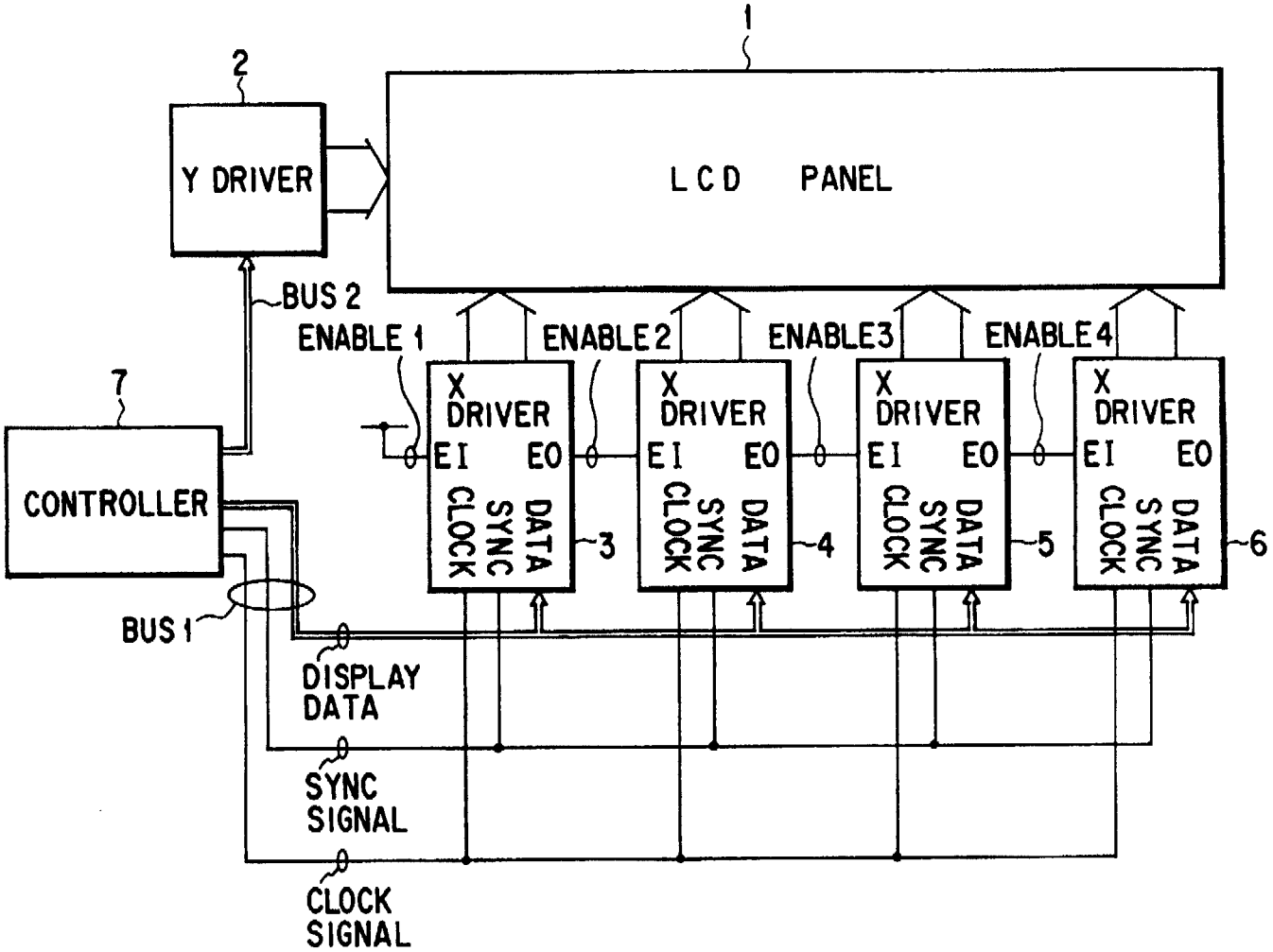
FIG. 1 is a block diagram showing a display device according to one embodiment of this invention.

FIG. 1 is a block diagram showing a liquid crystal display device according to one embodiment of this invention. An LCD (liquid crystal display) panel 1 includes scanning electrodes and signal electrodes (not shown) intersecting each other and a liquid crystal material disposed between the above two types of electrodes and liquid crystal pixels each formed of the liquid crystal material disposed between the electrodes at the intersection thereof are arranged in a matrix form to construct a display screen. As the panel 1, a so-called TFT type liquid crystal panel in which transistors are arranged at intersections of the scanning electrodes and the signal electrodes intersecting each other may be used.

A Y driver 2 for driving the scanning electrodes and four X drivers 3, 4, 5, 6 for driving four signal electrode groups obtained by dividing all of the horizontal signal electrodes in a horizontal direction are arranged in the peripheral portion of the LCD panel 1. A controller 7 outputs a clock signal supplied to the X drivers 3 to 6, a synchronization (SYNC) signal containing a start signal which will be described later and LOAD signal which are multiplexed with each other in a coding area of the SYNC signal and display data to the respective X drivers 3 to 6 via a bus BUS1. The controller also outputs control signals to the Y driver 2 via a bus BUS2. The Y driver 2 and the X drivers 3 to 6 are formed in an IC (integrated circuit).

The X drivers 3 to 6 are cascade-connected by a so-called enable chain system. That is, the first-stage X driver 3 receives an enable signal E1 at the base board and the other drivers 4, 5 and 6 are operated according to enable inputs E2, E3 and E4 input from the respective preceding stages to the respective enable terminals. The operation of each of the X drivers is interrupted when the operation of fetching the display data for driving the signal electrode group connected to the X driver is completed. At this time, the X driver outputs an enable output for driving the next-stage X driver from the EO terminal thereof. Thus, each of the X drivers starts to fetch data when the operation of the preceding-stage X driver is ended, and the operation thereof is effected for a period of time necessary for fetching data and then terminated. When all of the X drivers 3 to 6 have fetched data allotted to the respective X drivers, display signals of one horizontal period H for driving the signal electrodes are simultaneously output to the LCD panel 1 from the respective drivers 3 to 6 in response to the LOAD signal contained in the control signal SYNC from the controller 7.

Figure 2:
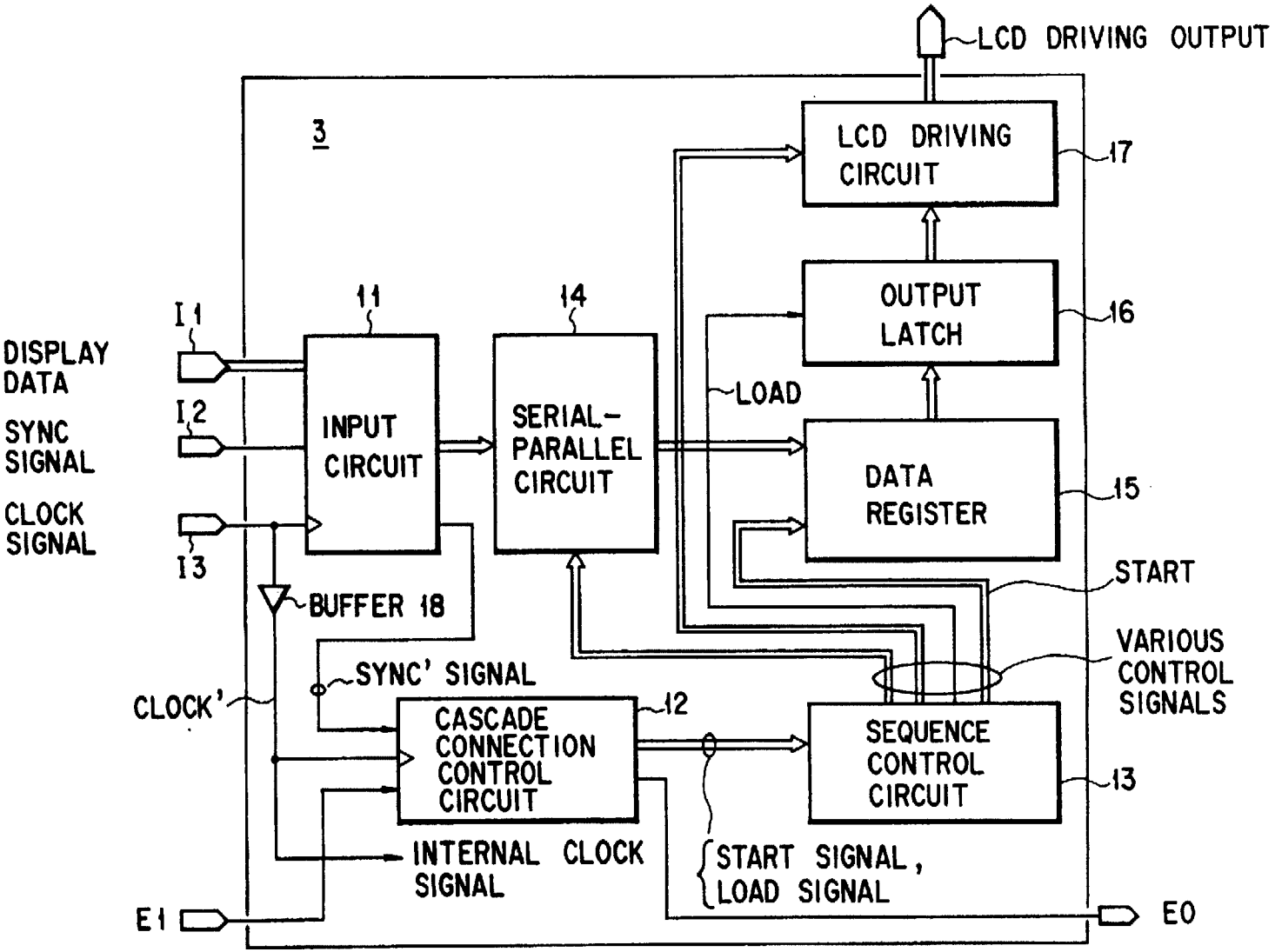
FIG. 2 is a block diagram showing a driving device according to one embodiment of this invention.

Next, the construction of the first-stage X driver 3 is explained with reference to FIG. 2. The other X drivers 4 to 6 have the same construction as that of the X driver 3.

The X driver 3 in this embodiment includes an input circuit 11, cascade connection control circuit 12, sequence control circuit 13, series-parallel converting circuit 14, data register 15, output latch 16, and LCD driving circuit 17. These elements are formed in a single IC circuit.

The input circuit 11 samples display data and the SYNC signal input via the group of the input terminals I1 and the input terminal I2 from the bus BUS1 in response to a clock signal supplied to the input terminal I3. Signal lines for supplying signals and clocks to the respective flip-flops provided in the input section are arranged to be as short as possible so as to make substantially equal the delay times caused in the respective signal lines. The display data is output to the data register 15 via the series-parallel converting circuit 14. In a case where the color display operation is effected, terminals of a number corresponding to the number of bits for each of the RGB pixels are used to receive display data.

The series-parallel converting circuit 14 is used as required in a case where the operation speed in the X driver 3 is not sufficiently high or where the flip-flop in the X driver 3 is driven by a multi-phase clock, and the number of operations of transferring display data can be reduced by converting the display data in a parallel form.

The data register 15 fetches display data allotted to the X driver 3 according to various control signals which will be described later and which are output from the sequence control circuit 13. The number of bus lines via which display data is input to the data register 15 is set to the number of bits for each of the RGB pixels, for example, when the color display operation is effected. After the operation of fetching the display data by the data register 15 is completed, a LOAD signal is input and the output latch 16 outputs display data to the LCD driving circuit 17.

The LCD driving circuit 17 subjects input display data to the digital-analog conversion and outputs the converted analog signals to the signal electrodes of the LCD panel 1 as LCD driving voltages.

The data fetch starting signal and load signal which the sequence control circuit 13 outputs to control the data register 15 and output latch 16 are generated in the cascade connection control circuit 12 by decoding the SYNC signal. That is, the cascade connection control circuit 12 receives a clock signal CLOCK' supplied via a buffer 18 which will be described later, a common start signal (START') obtained by decoding the synchronization signal (SYNC') output from the input circuit 11, and an enable input E1 input from the EI terminal as inputs to create a start signal START for controlling the timing at which the data register 15 starts the data fetching operation and a load signal LOAD for controlling the timing at which the output latch 16 outputs display data to the LCD driving circuit 17. In this embodiment, since the current capacity of a clock signal in the input circuit 11 for fetching display data is large, the clock signal is distributed to the cascade connection control circuit 12 and the other internal circuit via the buffer 18 of multi-stage structure in order to increase the current capacity. As a result, the delay of the clock signal in the buffer 18 becomes longer and delay circuits 112*a* to 112*n* are used in the input circuit 11 in order to set the phase of the output signal thereof coincident with the phase of the delayed clock signal.

Next, the construction and operation of the input circuit 11 and cascade connection control circuit 12 which are the main portions of the X driver 3 will be explained with reference to FIG. 3.

First, the construction of the input circuit 11 is explained.

The input circuit 11 includes flip-flops FF11, FF12, FF13, - - - , FF1*n*, FF2 and FF3, mask circuits 111*a* to 111*n* constructed by AND gates connected to the flip-flops FF11 to FF1*n*, and delay circuits 112*a* to 112*n* provided for the respective mask circuits.

The flip-flops FF11 to FF1*n* are latch circuits for sampling display data stream (DATA1, DATA2, DATAn) supplied to the D terminals thereof at times when the clock signal rises. The flip-flop FF2 is a circuit in which a synchronizing signal (SYNC signal) supplied to the D terminal thereof is sampled at times when the clock signal rises in the same manner as the DATA fetching operation to output a SYNC' signal from a Q output terminal so as to supply the SYNC' signal to the cascade connection control circuit 12. The mask circuits 111*a* to 111*n* are circuits for determining whether display data sampled by the flip-flops FF11 to FF1*n* should be transferred to the internal circuit of the X driver 3 or not. That is, transfer of display data to the internal circuit becomes unnecessary when the operation of fetching all the display data for the X driver 3 by the data register 15 is completed. If transfer of display data to be fetched to the other X driver is continuously effected, the stray capacitor or the like in the circuit is charged or discharged, thereby increasing the power consumption. Therefore, if the control operation is effected to interrupt the transfer of display data in the X driver which has terminated the display data fetching operation, the power consumption in the internal circuit of the X driver 3 can be reduced.

The mask circuits 111*a* to 111*n* are each constructed by a 2-input AND gate and receive display data output from the flip-flops FF1*a* to FF1*n* and an enable output E2 which is output from the EO terminal to the next-stage X driver as inputs thereof. Therefore, when the X driver terminates the operation of fetching corresponding display data and the enable output E2 is output to the next-stage X driver 4, transfer of display data in the X driver 3 to the internal circuit is interrupted.

Buffers BF1 to BFn are connected between the input terminals DATA1 to DATAn for display data and the flip-flops FF11 to FF1*n* of the input circuit 11 so as to prevent the flip-flops from being broken down by electrostatic electricity and the like.

As described before, the delay circuits 112*a* to 112*n* and 114 are used to more precisely set the output timing of the display output data DATA' from the input circuit 11 coincident with the operation timing of the other circuit including the cascade connection control circuit 12 operated by the clock signal CLOCK'. That is, the clock signal CLOCK' for controlling the operation timing of the other circuit is distributed via the buffer 18 and a time delay occurs in the buffer 18. The time lag between the output timing of the input circuit 11 and the operation timing of the other circuit can be kept small by adjusting the delay times of the mask circuit 111 and delay circuit 112 according to the delay time in the buffer.

The flip-flop FF3 is a circuit for sampling the enable input E1 input from the terminal EI to the D terminal thereof at the times of the clock signal CLOCK, supplied via the buffer 18, rises and supplying the sampled signal as a sampled enable signal EI' to the cascade connection control circuit 12.

Next, the internal construction of the cascade connection control circuit 12 is explained. The cascade connection control circuit 12 includes flip-flops FF41, FF42, FF43, FF44 and gate circuits 201 to 211. Further, the cascade connection control circuit 12 receives a SYNC' signal which is an output of the input circuit 11, a clock signal CLOCK' and an EI' signal as inputs and outputs a start signal START (which controls the timing at which the data register starts the data fetch), a LOAD signal (which controls the timing at which the output latch 16 fetches and outputs display data in the data register 15 to the LCD driving circuit 17) and an enable signal which is supplied to the EO terminal.

The SYNC' signal is supplied to the D terminal of the flip-flop FF41 via the delay circuit 114, to the non-inverting input terminal of the AND gate 201 and to the inverting input terminal of the AND gate 202. The sampled enable signal EI' is supplied to the non-inverting input terminals of the AND gates 203 and 205. The clock signal CLOCK' derived via the buffer 18 is supplied to the other internal circuit of the X driver as an internal clock signal and to the clock terminals of the flip-flops FF41, FF42, FF43, FF44 in the cascade connection control circuit 12.

The flip-flops FF41 and FF42 are circuits for cooperating with the gate circuits 201 to 208 to decode a load signal LOAD and a START' signal which is used as an original signal for creating the start signal START based on a SYNC' signal including the multiplexed input common start signal and the load signal. That is, the LOAD signal and START' signal are input from the terminal SYNC to the X driver 3 with the signals multiplexed in the synchronization signal SYNC.

The load signal LOAD, which is encoded as [011], is decoded based on the SYNC' signal from the delay circuit 114, the output of the flip-flop FF41 and the inverted signal of the output of the flip-flop FF42 as will be described later and then output from the AND gate 201.

The common start signal START' is encoded as [10]in the SYNC signal and is decoded from the SYNC' signal and the output signal from the flip-flop FF41 at AND gate 202. The flip-flop FF43 is set to a state representing the fact that it stores the data to enable the enable signal EI of the first stage. The flip-flop FF44 samples the signal EI' at the timing of the signal START'.

The enable signal E2 is output from the flip-flop FF44. The output of the OR gate 211 is supplied to the D terminal of the flip-flop FF44 and outputs of the AND gates 209, 210 are supplied to the inputs of the OR gate 211. The output of the AND gate 202 is supplied to one input of each of the AND gates 209, 210 and the output of the AND gate 203 is supplied to the other input of the AND gate 209. The output of the flip-flop FF44 is fed back to the other input of the AND gate 210.

Figures 3, 5:
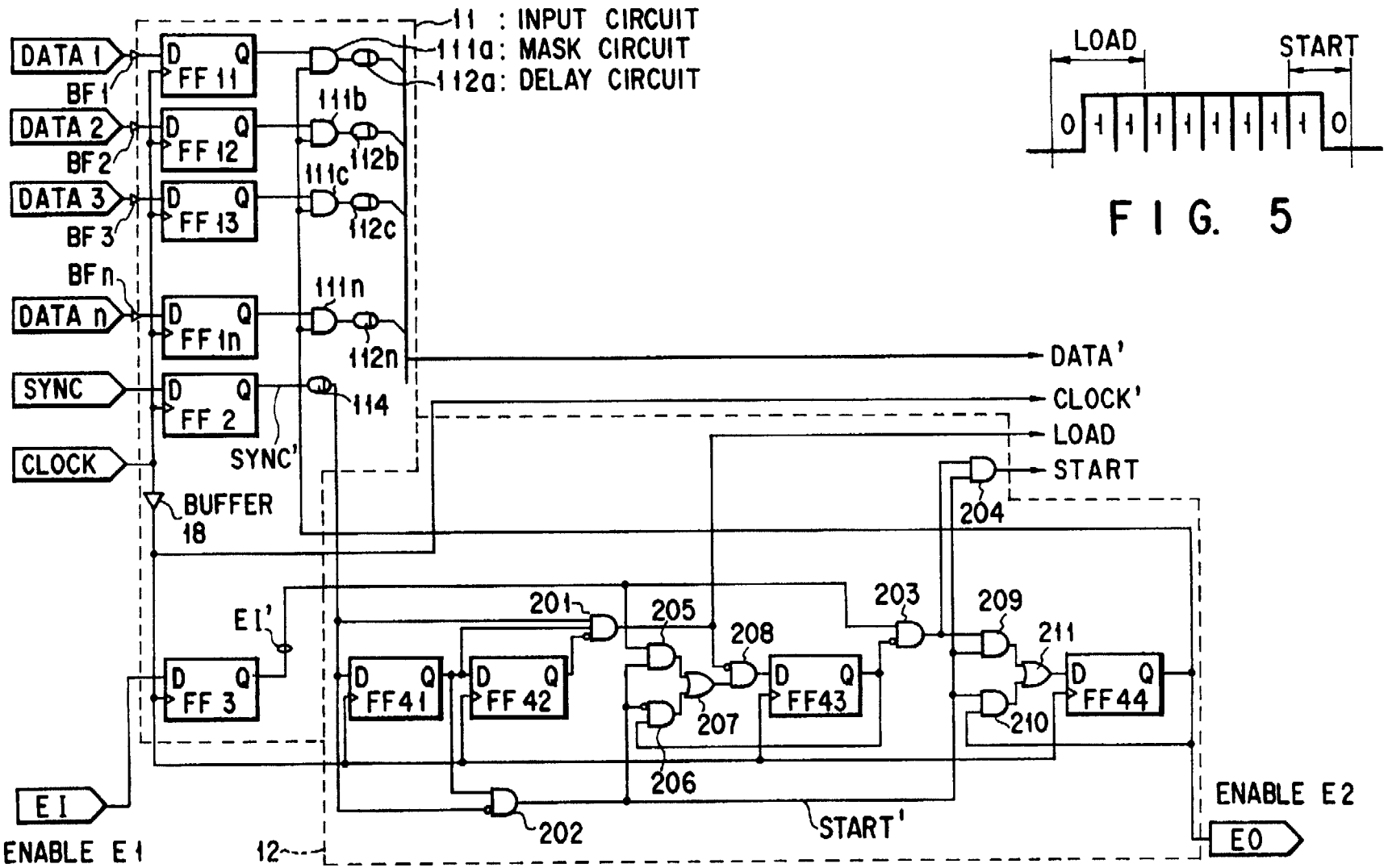
FIG. 3 is a circuit diagram showing the main portion of the driving device shown in FIG. 2.
FIG. 5 shows a modification of a sync signal in which a load signal and a start signal are multiplexed.
Figure 4A:
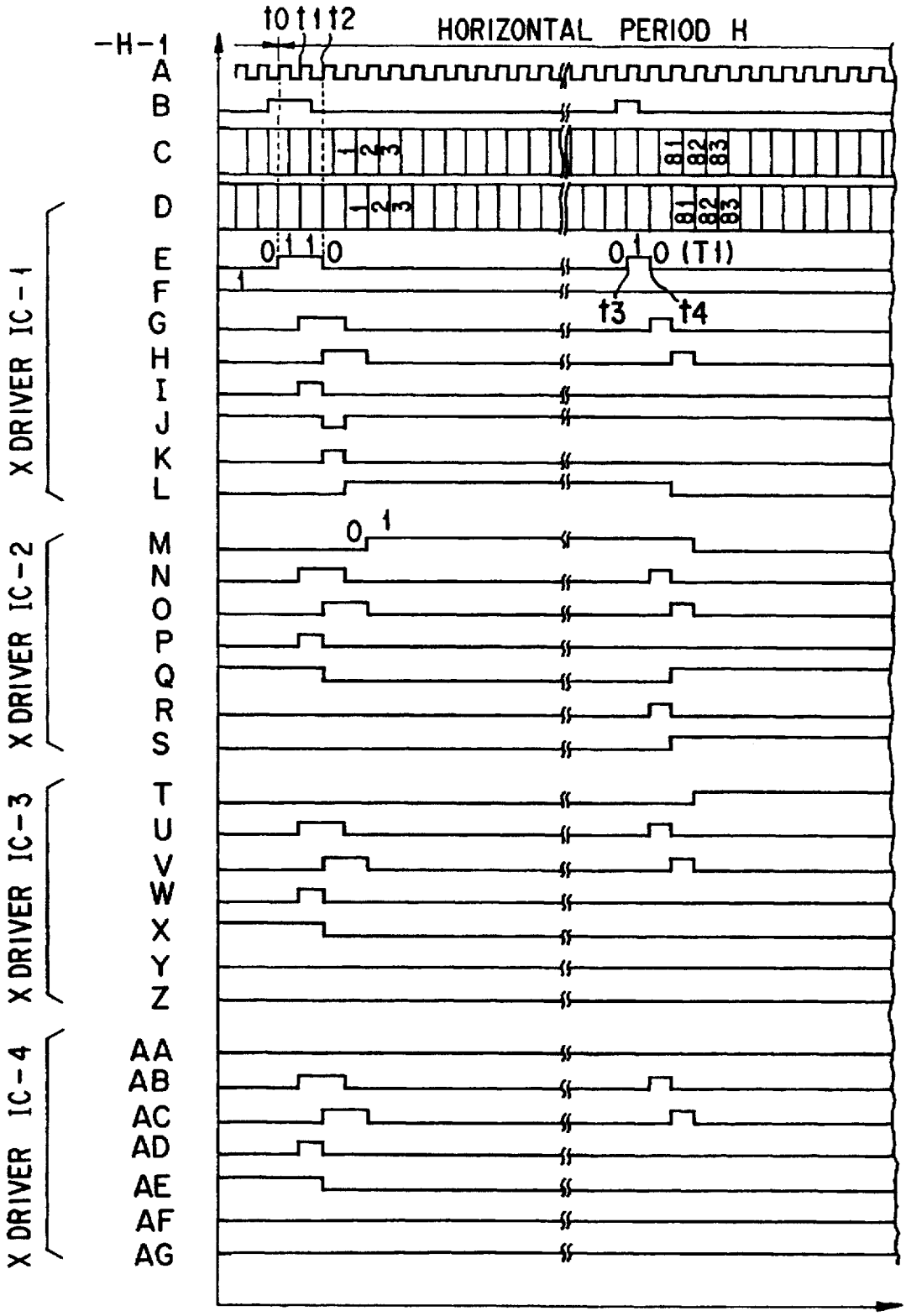
FIGS. 4A and 4B are timing charts of driving waveforms of a display device according to one embodiment of this invention.
Figure 4B:
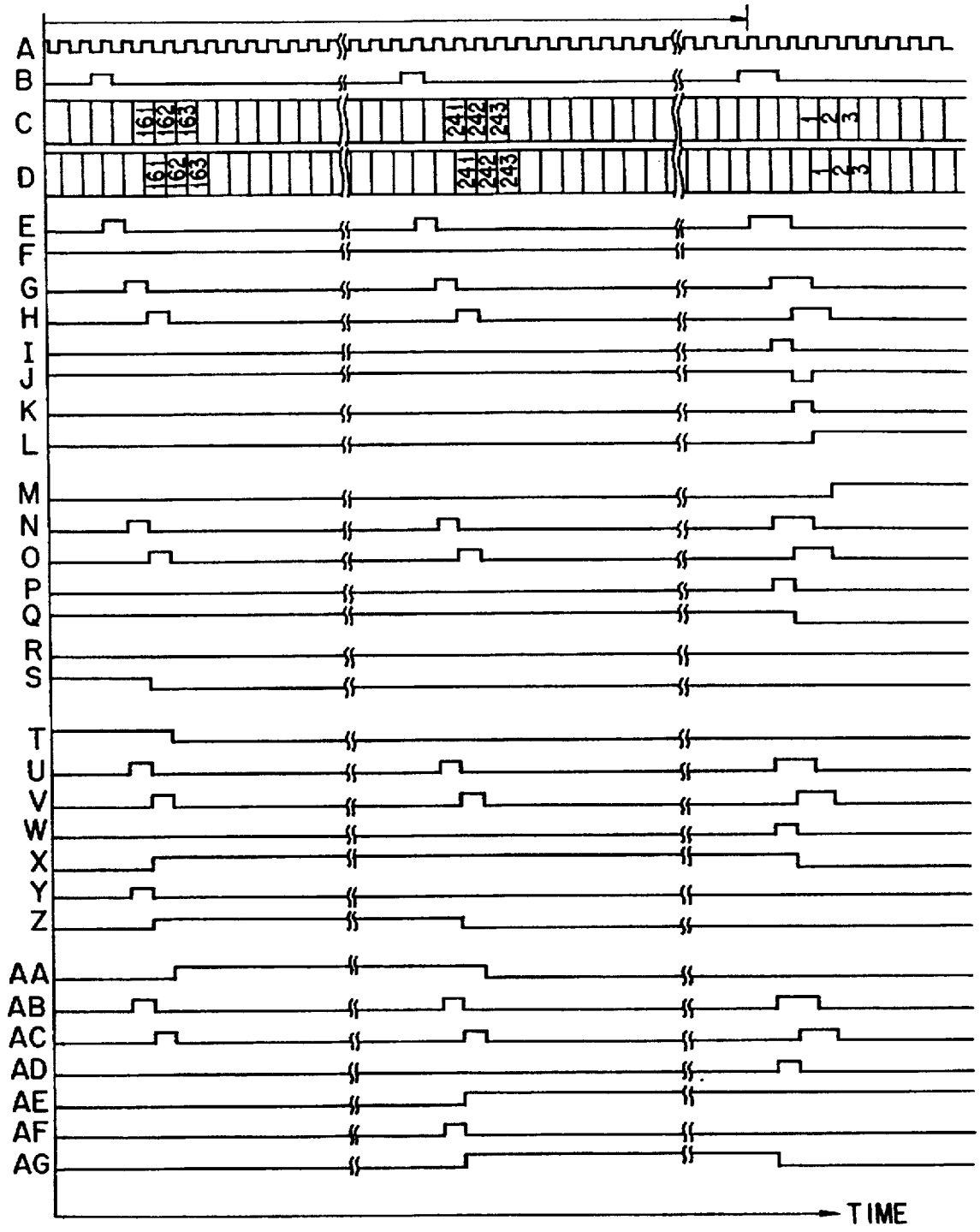

Next, the operation of the cascade connection control circuit 12 shown in FIG. 3 is explained with reference to FIGS. 4A and 4B. In FIGS. 4A and 4B, A is the clock signal, B is the SYNC signal, C represents display data, D represents display data latched into flip-flops FF11 to FF1*n* and derived via mask circuits 111*a* to 111*n* and delay circuits 112*a* to 112*n* and E is the SYNC signal from flip-flop FF2. F through L, M through S, T through Z and AA through AG represent signals from flip-flop FF3, flip-flop FF41, flip-flop FF42, LOAD, flip-flop FF43, START, and flip-flop FF44, of each of X Driver IC-1 to IC-4, respectively. FIG. 4B shows a continuation of FIG. 4A.

A in FIGS. 4A and 4B shows a clock signal supplied to the clock terminal CLOCK of FIG. 3. In the clock signal, one horizontal period starting at time $t_0$ is indicated by "H". B in FIGS. 4A and 4B shows a multiplexed synchronization signal supplied to the synchronization terminal SYNC, and C in FIGS. 4A and 4B shows display data supplied to the data terminals DATA1 to DATAn. In this example, the display data is data having 320 picture elements in one horizontal period. Therefore, 320/4=80 pixels are fetched by the first-stage X driver 3 formed in the IC. As shown by D–L in FIGS. 4A and 4B, display data of 80 picture elements latched in the flip-flops FF11 to FF1*n* of the input circuit 11 and derived via the mask circuits 111*a* to 111*n* and delay circuits 112*a* to 112*n* is latched at a timing slightly delayed with respect to the input data C in synchronism with the rising edge of the clock signal. Likewise, the synchronization signal E supplied from the flip-flop FF2 to the cascade connection control circuit 12 via the delay circuit 114 is synchronized with the rising edge of the clock signal but slightly delayed with respect to the input signal SYNC' shown as B in FIGS. 4A and 4B.

First, in a period of three clocks starting from the starting time $t_0$ in the horizontal period H, the SYNC' signal varies to have a logical value of "011" and varies from "1" to "0" at the fourth clock. When the signal varies from "1" to "1" at the third clock, the output of the FF41 is set to "11". At this time, the output of FF42 is kept at "0". Therefore, the output of the AND gate 201 is set to "1" and the output of the AND gate 208 is set to "0". As a result, the output of the FF43 becomes to "0".

That is, a signal of the logical AND of the output of the FF42 and the SYNC' signal is output as the LOAD signal "1" from the AND gate 201. As a result, display data accumulated in the data register 15 in the preceding horizontal period (H-1) is fetched in the output circuit 16, the fetched data is output from the driving circuit 17 and the LCD driving voltage is supplied to the LCD panel 1. At this time, the inverted signal of the LOAD signal is input to FF43 to reset FF43 and the output of FF43 is set to "0" as described before.

At time t2, the output of FF41 is set at "1", and at this stage, the output of FF42 is becomes "1". Therefore, the output of the AND gate 201 is changed to "0", the LOAD signal is set to "0".

By the next rising edge of the clock, the SYNC' signal falls to "0". At this time, since the output of the FF41 is "1", the output of the AND gate 202 is set to "1".

That is, when the SYNC' signal is changed to "10" the start signal START' is output.

The START' signal is input to the AND gate 204 and a signal of the logical AND of the START' signal and the logical AND value of the inverted signal of the Q output of FF43 and the EI' signal derived from the AND gate 203 is used as the START signal.

That is, when the SYNC' signal is set to "10" at time t4 and the START' signal from the AND gate 202 is changed to "1", the output of the AND gate 208 is set to "0", and since the output of the FF43 is "0" and the EI' signal is "1" only in the first-stage X driver 3, the START signal is set to "1" only in the first-stage X driver 3 and the START signal is kept at "0" in the other X drivers. As a result, in the first-stage X driver 3, the data register 15 supplied with the START signal of "1" starts to fetch display data and fetches 80 sets of data.

Further, FF44 samples the logical AND output of the EI' signal and the inverted signal of the Q output of the FF43 derived from the AND gate 203 when the START' signal from the AND gate 202 is set at "1". Since the EI' signal and the inverted output of the FF43 are both set at "1" in the first-stage X driver 3, the output of the AND gate 209 is set to "1", that is, the Q output of the FF44 is set to "1". Therefore, the enable output of "1" is derived from the EO terminal of the first-stage X driver 3. Since the EI' signal is "0" in the other X drivers 4 to 6, the enable output is kept at "0".

The enable output E2 is preferably set to "1" when a period of one to two clocks has elapsed after the SYNC' signal was changed to "10" at time t2. That is, the enable output E2 is a signal used when the next-stage X driver (in this case, X driver 4) starts to fetch data, but when the rising edge of the clock signal is delayed, for example, if the threshold voltage of the clock input of the second-stage X driver 4 is higher than that of the first-stage X driver 3, the operation of the second-stage X driver 4 is delayed. If the delay time is longer than the delay time of the enable output E2 in the first-stage driver, the second-stage driver 4 fetches the enable output E2 of the first-stage driver at the rising edge of the clock which is the same as the clock which caused the first-stage driver 3 to change the enable output E2. As a result, there occurs a possibility that the second-stage driver 4 fetches data partly overlapping the display data fetched by the first-stage driver 3. In order to cope with this case, the enable output E2 of the first-stage driver 3 may be delayed by a period of one to two clocks with respect to a variation in the SYNC' signal.

When the operation of fetching display data by the data register 15 is completed, the control operation is effected to change the SYNC' signal to "010" at the timing T1 so as to interrupt the data fetch by the first-stage driver 3 and start the data fetch by the next-stage driver 4.

That is, if "010" is input as the SYNC' signal, FF42, FF41 and FF43 are respectively set into the "0 ", "1" and "1" states. Therefore, the LOAD signal is kept at "0" and the START' signal is set to "1". At this time, the enable signal E1="1" is kept input to the first-stage X driver 3, but since the Q output of the FF43 is "1" and the inverted signal of the output of FF43 is input to the AND gate 203, the START signal of the first-stage X driver 3 is set to "0".

In the second-stage X driver 4, since the enable signal E2 is "1", the output of the flip-flop corresponding to FF43 is "0" and a signal corresponding to the EI' signal created based on the E2 signal is "1" so that the START signal is set to "1" and the data register of the second-stage X driver 4 corresponding to the data register 15 will start to fetch display data. Since EI' signals created based on E3, E4 are "0" in the third- and fourth-stage X drivers 5, 6, the START signal is "0" and the data fetch is not effected.

When the START' signal is set to "1", the flip-flop corresponding to FF44 samples the logical AND output of the EI' signal and the inverted signal of the output of the flip-flop corresponding to FF43. Since the Q output of FF43 is "1", in the first-stage X driver 3, the output of FF44 is set to "0" and the enable output E2 is set to "0". On the other hand, since the Q output of the flip-flop corresponding to FF43 is "0" and the EI' signal is "1" in the second-stage X driver 4, the enable output from the EO terminal is set to "1". Since EI' signals are "0" in the third- and fourth-stage X drivers 5, 6, the enable output is "0".

Further, the mask circuits of the input circuit of each driver corresponding to the mask circuits 111*a* to 111*n* of the input circuit 11 of the driver 3 transfer display data to the internal circuit only when the output from the EO terminal of each driver is set at "1". Therefore, as indicated in the timing chart of FIGS. 4A and 4B, the output from the EO terminal of the first-stage X driver 3 correspond s to a period from the first to eightieth picture elements of the display data DATA'.

Thus, the data fetching operation by the first-stage X driver 3 is completed and the second-stage X driver 4 starts to fetch data. After this, the third- and fourth-stage X drivers 5, 6 fetch data in the same manner as described above, and then the the LOAD signal is set to "1" and the LCD driving voltage for driving the 320 pixels is supplied to the LCD panel 1.

As described above, in the display device of this embodiment, the SYNC signal for controlling the operation of the X drivers connected in the enable chain form, that is, the START signal contained in the SYNC signal is synchronized with the clock signal by which the input circuit samples display data. Therefore, the margin for adjustment of the delay times of both of the above signals can be reduced and the frequency of the clock signal can be enhanced.

Further, in this embodiment, the START signal and LOAD signal are multiplexed as the SYNC signal as described before. The code assignment is made based on the START signal of "010" appearing after the LOAD signal of "011" by plural times (four times in the above embodiment: it appears in combination with the LOAD signal at the first time and appears independently at the remaining three times) corresponding to the number of divided X drivers in one horizontal period and then the LOAD signal appears again in the next horizontal period, and signals which can be easily decoded are selected. Therefore, the number of input wirings to the driver IC can be reduced, the area occupied by the wirings to the driver circuit in the display device can be reduced, electromagnetic noise can be reduced, and the operation speed can be further enhanced. Further, since the number of signals input from the controller to the driving device is reduced, the adjustment of timings between a plurality of input signals can be simplified.

Further, the SYNC signal and display data which is a high-speed signal are supplied to the drivers via the bus lines which are common for all of the drivers. Therefore, since the loads of the display data and SYNC signal are substantially equal to each other, the delay times of the above signals are not significantly different from each other.

This invention is not limited to the above embodiment and can be variously modified. For example, in a case where the total number of output terminals of the driver formed in the IC is larger than the number of electrodes of the liquid crystal panel, a method of providing dummy electrodes which are not used for display (that is, which are not connected to the picture element electrodes of the panel) on the liquid crystal display side and connecting the remaining output terminals of the driver to the dummy electrodes is used.

In this case, it is preferable to set the number of remaining terminals of each driver to the same value and connect the remaining terminals to the dummy electrodes of the panel additionally provided for the remaining terminals. That is, according to this method, the loads of the input signals in the respective drivers are substantially equal to one another, and a variation in the output voltage between the drivers can be reduced.

In this case, it is necessary to interrupt the fetch of display data for the remaining terminals in each driver, but this may be attained by fetching display data of the terminals used for display and then driving the next-stage driver so as to start to fetch display data of the terminals used by the next-stage driver for display by adequately changing the START signal.

While in the above-mentioned embodiment the 3-bit (011) load signal and the 2-bit (10) start signal are combined as a continuous 4-bit signal (0110) as shown in FIGS. 4A and 4B, the load and start signals can be separated as shown in FIG. 5.

By setting a predetermined period of time between the fetch of the load signal and the fetch of the start signal as shown in FIG. 5, it is possible to fetch the display data accurately even if the undesirable voltage fluctuation occurs at the signal input section.

As described above, according to the driving device and display device of this invention, a reduction in the timing margin by a variation in the delay times of the start signal and clock signal which are control signals for the cascade connection of the X drivers can be suppressed and the frequency of the clock signal can be enhanced. Therefore, the drivers can be operated at high speed and the performance suitable for display of a large amount of data can be attained.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A driving device comprising:

a first driving unit and a second driving unit for driving a first electrode group and a second signal electrode group formed by dividing signal electrodes of a display device, respectively;

a signal bus for supplying display data and a clock signal to the first driving unit and the second driving unit, simultaneously; and means for supplying an external enable signal to the first driving unit, wherein the first driving unit comprises:

first control means for sampling the external enable signal to generate a first internal start signal and a first internal enable signal, and first data holding means for fetching the display data corresponding to the first driving unit on the signal bus for a preset period according to the first internal start signal;

the second driving unit comprises:

second control means for sampling the first internal enable signal to generate a second internal start signal, and second data holding means for fetching the display data corresponding to the second driving unit on the signal bus for the present period according to the second internal start signal; and the first driving unit and the second driving unit include means for driving the first signal electrode group and the second electrode group according to the display data fetched in the first data holding means and the second data holding means, respectively.

2. A driving device according to claim 1, further comprising an input section having latch means for receiving control signals including an external start signal, the external enable signal, the clock signal and the display data and latching the external start signal and the display data in synchronism with the clock signal.

3. A driving device according to claim 2, wherein the input section includes mask means for interrupting output of the display data from the latch means when data fetching by at least one of the first data holding means and the second data holding means is completed.

4. A driving device according to claim 3, wherein:

each of the first data holding means and the second data holding means includes means for outputting a next-stage enable signal to a succeeding driving unit when an operation of fetching and storing the display data of the preset period is completed, and the mask means includes gate means for inhibiting passage of the display data in response to the next-stage enable signal.

5. A driving device according to claim 1, further comprising a latch section latching the display data output from one of the first holding means and the second data holding means for a second preset period of time and then outputting the display data to the driving means.

6. A driving device according to claim 2, wherein the input section includes one input terminal supplied with the external start signal being multiplexed with at least one of the control signals supplied to the input section in a coding area.

7. A driving device according to claim 2, further comprising a latch section latching the display data output from one of the first holding means and the second data holding means for a second preset period of time and then outputting the display data to the driving means.

8. A driving device according to claim 7, wherein at least one of the control signals input to the input section multiplexed with the external start signal is a load signal for controlling a timing at which the latch section outputs the display data to the driving means.

9. A driving device according to claim 8, wherein the load signal is coded by 3 bits "001", and the external start signal is coded by 2 bits "10".

10. A driving device according to claim 9, wherein each of the first and the second control means comprises:

first decoding means including first and second flip-flops and a 3-input AND gate for decoding the load signal of three bits "011", and second decoding means including a third flip-flop and a 2-input AND gate for decoding the external start signal of two bits "10".

11. A driving device according to claim 1, wherein:

the first control means includes means for sampling the external enable signal in response to switching of an external start signal to output the first internal start signal;

the second control means includes means for sampling the first internal enable signal in response to switching of the external start signal to output the second internal start signal; and the driving means comprises means for converting the display data into a driving voltage to generate a corresponding optical signal.

12. A driving device according to claim 1, wherein the display device comprises:

a liquid crystal display panel having a plurality of scanning electrodes, a plurality of signal electrodes divided into the first and the second signal electrode groups; and liquid crystal portions arranged at intersections between the scanning electrodes and the signal electrodes.

13. A driving device according to claim 1, wherein each of the first and the second driving units is formed in an integrated circuit.

14. A display device comprising:

a bus carrying display data, sync and clock signals; and a first and a second driving unit for driving a first and a second electrode group formed by dividing signal electrodes of the display device, respectively, the bus being connected to input terminals of each of the first and the second driving units, wherein:

an external enable signal is provided as input to the first driving unit, a cascaded enable signal is output from the first driving unit and supplied as input to the second driving unit, and the first and the second driving units comprise:

means for driving the first and the second electrode groups according to the display data; and means for sampling one of the external enable signal and the cascaded enable signal to generate a load signal and an internal start signal based on the sync signal, the load signal controlling a timing at which the display data is output to the driving means, and the display data being fetched at a time based on the internal start signal.

* * * * *